United States Patent [19]

Struckmann

[11] Patent Number: 4,978,096

[45] Date of Patent: Dec. 18, 1990

[54] SUPPORT FOR BOOK AND READING MATTER

[76] Inventor: Holger Struckmann, 104 S. Alward Ave., Basking Ridge, N.J. 07920

[21] Appl. No.: 302,186

[22] Filed: Jan. 26, 1989

[51] Int. Cl.[5] ..... A47B 97/04

[52] U.S. Cl. ..... 248/451; 24/18; 24/71.2; 248/455; 248/461

[58] Field of Search ..... 248/451, 452, 453, 454, 248/455, 461; 24/71.2, 18

[56] References Cited

U.S. PATENT DOCUMENTS

| | | | |
|---|---|---|---|
| 351,256 | 12/1895 | Brown | 248/451 |
| 588,213 | 8/1897 | Beekly | 24/71.2 |
| 2,193,907 | 3/1940 | Love . | |
| 2,542,718 | 2/1951 | Snell . | |
| 2,572,731 | 10/1961 | Keith . | |
| 2,810,231 | 10/1957 | Lykes | 248/451 |
| 2,834,149 | 5/1958 | Flahive et al. . | |
| 3,424,283 | 1/1969 | Sheldon | 248/461 |
| 3,747,889 | 7/1973 | Gerald . | |
| 3,813,075 | 5/1974 | Capper | 248/451 X |
| 4,116,413 | 9/1978 | Andersen . | |
| 4,296,946 | 10/1981 | Larre et al. | 248/451 X |
| 4,555,128 | 11/1985 | White et al. | 248/451 X |
| 4,592,285 | 6/1986 | Egli | 248/455 X |

FOREIGN PATENT DOCUMENTS

| | | | |
|---|---|---|---|
| 176863 | 10/1906 | Fed. Rep. of Germany | 248/455 |

*Primary Examiner*—David L. Talbott
*Attorney, Agent, or Firm*—Martha G. Pugh

[57] ABSTRACT

This comprises a lightweight support for books and magazines comprising a baseboard which seats on the lap of the user or other substantially horizontal surface, and a book plate which is adjustable to a desired angular position relative to the baseboard. A particular feature is a tensioning mechanism for holding the pages in place which comprises a line anchored between an adjustable spool at one end and a detachable elastically-biased hook at the other end, which functions to hold the center of the reading material relatively perpendicular to the reader's line of sight.

8 Claims, 3 Drawing Sheets

SUPPORT FOR BOOK AND READING MATTER

BACKGROUND OF THE INVENTION

This relates in general to a support for books and reading matter, more particularly of a type useful for facilitating reading in bed or from a sitting position with the device supported on the reader's lap, or alternatively, on the bed, or desk, or table, so that the line of sight is largely perpendicular to the center of the plane of the reading matter.

The use of book and copy holders is well-known in the prior art. In general, they have the disadvantages of being heavy and cumbersome, and requiring a large number of mechanical parts which require adjustment. Furthermore, once set up to hold the reading matter in place, readjustment is required whenever a page is turned.

It is therefore one object of this invention to provide an improved, simple, lightweight device for supporting books or other reading matter, such as magazines, on the reader's lap or bed or desk or other flat surface, such as a bed table, which is readily adjustable so that the line of sight of the reader is substantially perpendicular to the plane of the page to be read. Another obJect of the invention is to provide a device for supporting books and magazines in a position in which the pages are held in place at the desired tension and are readily turned with a minimum inconvenience to the reader.

BRIEF DESCRIPTION OF THE INVENTION

These and other obJects are realized in accordance with the present invention in a supporting device which consists of two maJor elements: (a) an adjustable lightweight stand which permits the reading material to be supported on the reader's lap, table or bed table so that the line of sight is largely perpendicular to what is being read, and (b) a tensioning system for holding the book or reading matter open and in place on the stand. The lightweight support stand comprises a book support plate which is angularly adJustable so as to be nearly vertical for bed use or nearly flat for some forms of table use. Construction of the support stand is of rugged lightweight material. Although the combined weight of book and support will be more than the book alone, there is less strain on the reader, because the combination need not be held up manually to be in a suitable reading position. Generally the reader's hands are free, only being required for turning the pages.

The tensioning mechanism, which holds the book open and its pages in place, consists of three principal parts, (c) an adjustable spool anchored and held in place on one side of the book support plate, (d) a line, which may be a single filament, runs from the spool across the face of the open book to (e) the tensioner, anchored on the other side of the plate. A pair of channels or other means mounted adjacent opposite edges on the underside of the support plate, extend almost the full height of the plate and have holes drilled in the downside leg of each of the channels for bolting or doweling the spool to its respective outside edge. A hook arrangement on the tensioner is used with the line to connect a spring, a rubber band or a braided elastic band to hold it in place on the tensioner. When a page is turned by the reader, the tensioner is depressed first to unhook and release the line, then raised to permit the page to be turned and then finally rehooked and anchored. There is a relatively wide, stiff alignment area over and across the back of the hook which, when pressed against the channel wall, insures that the hook is applied squarely to the channel wall, by the reader's touch, without the reader having to take his eyes off the book. With the hook arrangement, the tensioner can be rocked, tilted or slightly slid up or down the channel in case the print is so fine that the line interferes with reading.

The spool arrangement tethering the other end of the line is also adJustable to avoid interference with reading. Radial slots, which are cut in the outside edge of the large disc next to the spool, do not extend clear down to the top surface of the book support plate. This permits the disc to be rôtated, or to be rocked slightly, if the line should obstruct reading.

The spool arrangement is such that a small hole, away from, and at right angle to, the spool axle, permits a means for tying the end of the line before reeling the line onto the spool. The free end of the line is then laid in a slot in the large spool disc and brought over across the book support plate and tied to the spring or elastic in the tensioner. With this arrangement the support can handle thin magazines or thick, heavy books by merely reeling line in or out as required.

These, and other obJects, features and advantages will be apparent from a detailed study of the invention with reference to the attached drawings.

SHORT DESCRIPTION OF THE DRAWINGS

DETAILED DESCRIPTION OF THE INVENTION

Figure 1:
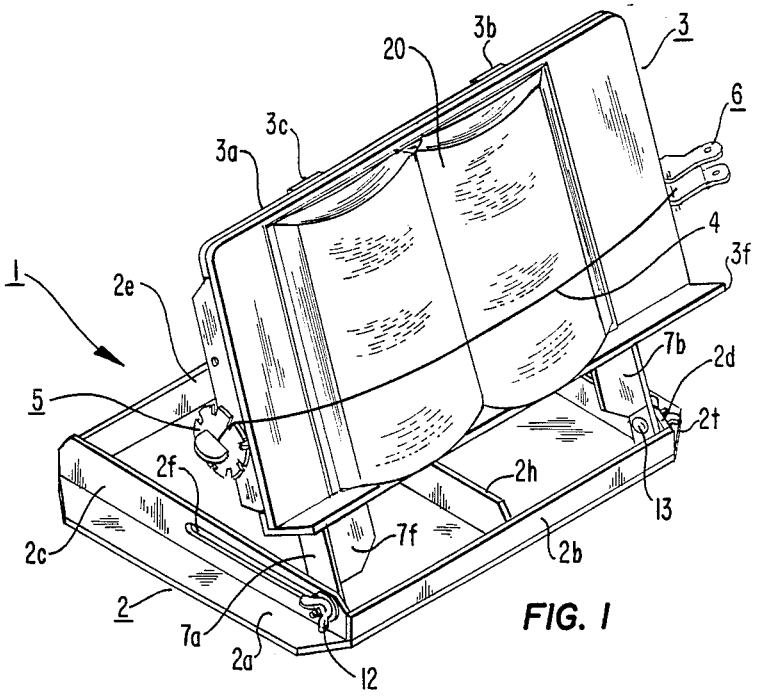
FIG. 1 is a perspective showing of the support for books and reading matter of the present invention, oriented for lap reading, as viewed from the front left-hand corner.
Figure 2:
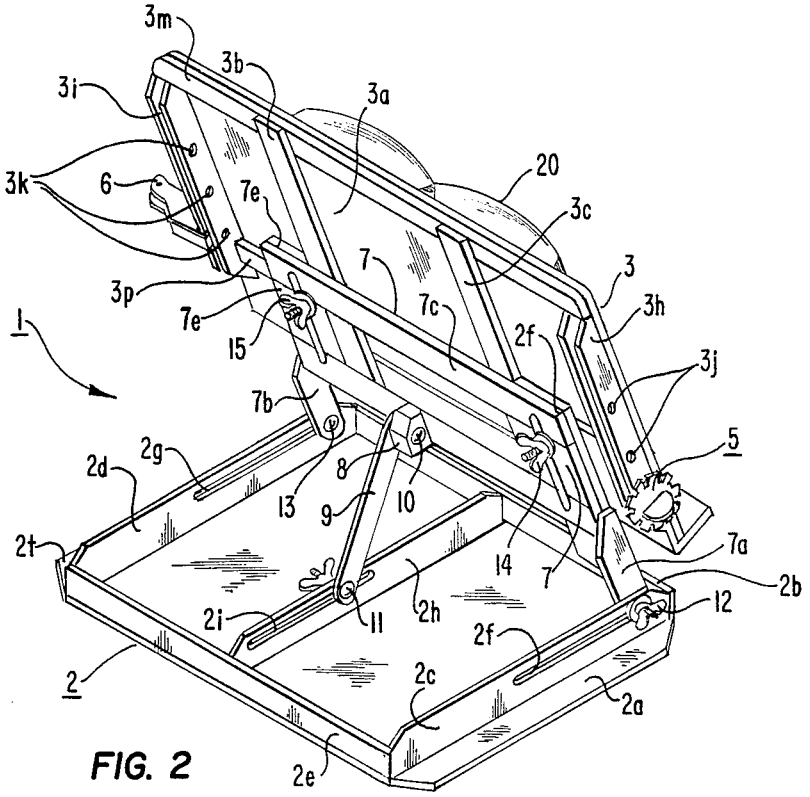
FIG. 2 is a rear perspective view of the support of FIG. 1.
Figure 3:
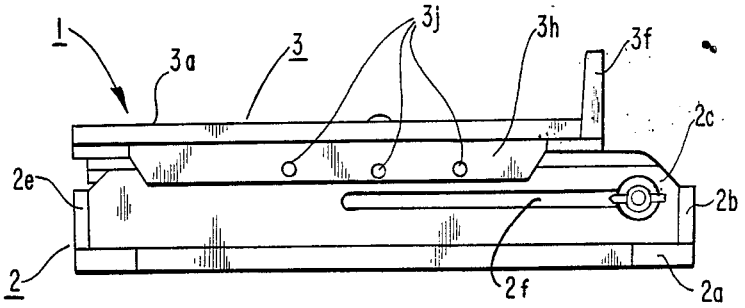
FIG. 3 is a side-elevational showing of the left-hand side support of FIGS. i and 2, folded up in storage position.
Figure 4:
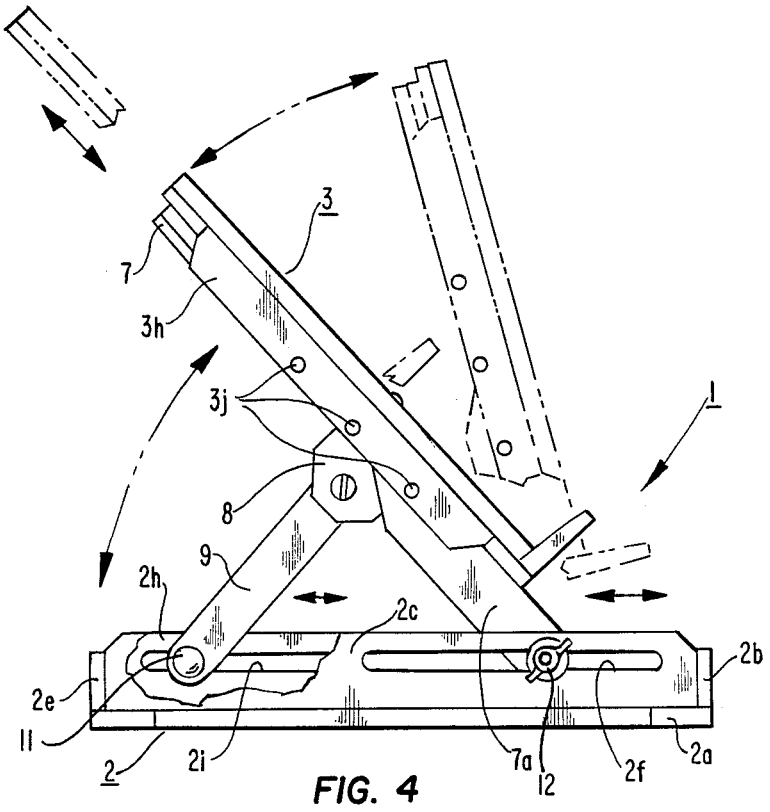
FIG. 4 is a side-elevational showing of the left-hand side the support of FIG. 3 in partly raised position.
Figure 5:
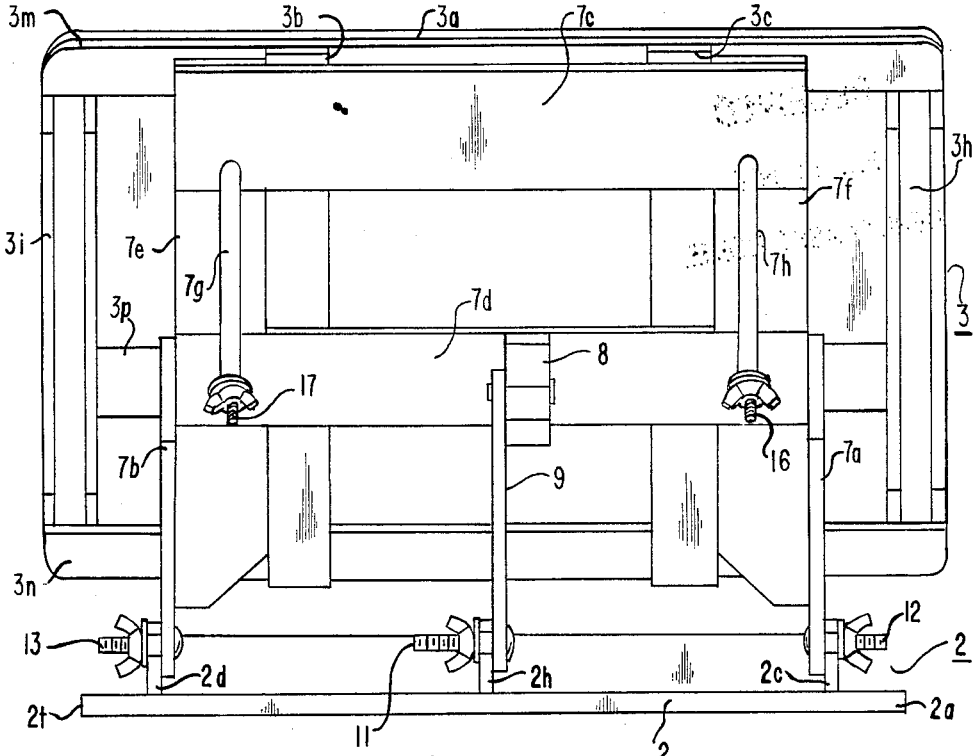
FIG. 5 is a rear-elevational view of the support of FIGS. 1 and 2 in raised position.

Referring to FIGS. 1–5, the book or magazine support of the present invention is mounted on a baseboard 2, which in the present example is of +generally rectangular form, say, 11 by 15 inches overall, and ¼ inch thick. It may be formed of wood, or rigid plastic, or any solid material which is strong and lightweight. Mounted on the upper surface of baseboard 2 is a shallow rectangular base frame. This comprises a pair of parallel front and back members **2*b* and 2*e*, each 12 ½ inches long, 1 inch wide and ¼ inch thick, which are respectively mounted edgewise on the front and rear edges of the upper surface of baseboard 2, normal to a pair of lateral frame members 2*c* and 2*d*, each 10 ½ inches long, 1 ¼ inches high and ¼ inch thick. The lateral edges of frame members 2*c* and 2*d* are each disposed 1 ¼ inch from the lateral edges of the baseboard 2, providing proJecting lips 2*a* and 2*t*** on opposite sides, the sharp corners of which may be rounded for convenience.

Centered between and parallel to the frame members 2c and 2d is a member 2h of similar dimensions, but in reversed direction to connect to adJustable strut 9.

The back supporting frame 7 is a flat rectangular frame comprising a pair of parallel cross-boards 7c and 7d each 1 $\frac{5}{8}$ inches wide and extending 11 $\frac{3}{8}$ inches on its long sides, and $\frac{1}{4}$ inch thick, and connected at its ends by a pair of guide boards 7e and 7f, each 9 $\frac{1}{2}$ inches long and 1 $\frac{5}{8}$ inches wide. The guide boards 7e and 7f are each $\frac{1}{2}$ inch in section in the central portion between 7c and 7d, being stepped back to thicknesses of $\frac{1}{4}$ inch at their two ends to accommodate and secure the ends of 7c and 7d in flush mating relation, thus providing guides for slideably accommodating the cross-bars 3b and 3c attached to the book plate 3, as described hereinafter.

The back supporting frame 7 is securely supported at its inner lower corners between the inner faces of a pair of struts 7a and 7b comprising flat boards each $\frac{1}{4}$ inch thick and 6 inches long, and 1 $\frac{1}{4}$ inches in overall width, rounded at the lower end and being cut back at an angle approximating 60 degrees with the lateral edge at the upper ends. The inside faces at the upper ends of struts 7a and 7b are glued or otherwise firmly secured in normal relation to the respective outside ends of the cross-board 7d. On the inside back face of the lower cross-board 7d, centered 5 inches from one end, is fastened a semicylindrical member, through the thickness of which is drilled a hole which accommodates a laterally-extending bolt 10 in rotatable relation.

A central strut 9 which is 6 inches long, $\frac{7}{8}$ inches wide, and $\frac{1}{8}$ inch thick, and is rounded at the top and bottom, has a screw hole near the top through which is fastened the other end of the screw 10.

The central frame member 2h, which is fastened between the front and rear sides 2b and 2e of the frame 2, has a longitudinal slot 2i about 5 inches long and $\frac{1}{4}$ inch wide, which terminates about 1 inch from rear frame member 2e. This serves to accommodate the inner end of the screw 11 which passes through the lower end of the strut 9 and is secured at a desired position along the slot 2i by a wing nut which is tightened in place, thereby supporting the back supporting frame 7 in a desired angular relation to the frame 2.

Similarly, the lateral frame members 2c and 2d each have longitudinal slots 2f and 2g, about 5 $\frac{1}{2}$ inches long and $\frac{1}{4}$ inch wide, which extend on each side from the central area to about $\frac{1}{2}$ inch from the front end of the front of frame 2. These slots respectively accommodate the shanks of screws 12 and 13 which extend through the lower ends of the struts 7a and 7b and are secured in a desired position along the slots by tightening wing nuts in place. Thus, the angular position of the back supporting frame 7 is controlled by sliding each of the shanks of screws 11, 12 and 13 along its respective slot, and tightening the wing nuts in place.

The book plate 3 which is disposed to be supported against the back supporting frame 7, is 16 inches long and 9 inches wide, and say, $\frac{1}{4}$ inch thick, and may be formed of wood or rigid plastic, or any material which is lightweight and rigid. Normal to and across the lower end of back plate 3 is firmly secured a lip 3f which is 16 inches long, 1 $\frac{5}{8}$ inches wide and $\frac{3}{8}$ inch thick, which serves as a rest for the books or magazines which are mounted on the book plate 3. The top side of this lip is slightly tapered to ease the turning of the papers being read.

Fastened across the upper and lower ends of book plate 3 on its rear face, are a pair of boards 3m and 3n, each 16 inches long, 1 inch wide and $\frac{1}{4}$ inch thick. Disposed along the opposite lateral edges of book plate 3, extending between and normal to each of the boards 3m and 3n are a pair of channels 3h and 3i, each 7 $\frac{1}{4}$ inches long, with sides $\frac{1}{8}$ inch thick, measuring 1 inch wide externally, and each providing between their sidewalls an internal U-shaped channel $\frac{5}{8}$ inch wide and $\frac{3}{4}$ inch deep.

Centered respectively 2 $\frac{3}{4}$, 4 $\frac{1}{4}$ inches and 5 $\frac{3}{4}$ inches below the top of the channels 3h and 3i, are a series of holes 3j and 3k drilled through the thickness on each side, the function of which will be described hereinafter.

Parallel to the top bar 3m, its edge being disposed about 3 $\frac{3}{4}$ inches below the top, is an intermediate bar 3p which is 14 inches long, 1 $\frac{1}{8}$ inches wide and $\frac{1}{4}$ inch thick, and which is secured against the rear face of 3 between the inside walls of 3i and 3h.

Four inches in from each of the ends of the top and bottom bars 3m and 3n are the normally-disposed cross-bars 3b and 3c. The two bars 3b and 3c are each 9 inches long and 1 inch wide, and are superposed over and fixed to 3m, 3p and 3n.

The inner edges of 7e and 7f on back supporting frame 7 form between them a recess which accommodates and slideably engages the outer edges of 3b and 3c, enabling the book plate 3 to slide to a position beyond the upper edge of the back supporting frame 7 so that the center of the book can be adjusted to be reasonably perpendicular to the reader's line of sight, i.e. to accommodate variations in the reader's body height if held on the lap.

The lateral members 7e and 7f of the back supporting frame 7 are each equipped with a longitudinal slot 7g, 7h, each 4 $\frac{1}{2}$ inches long and $\frac{1}{4}$ inch wide, and each spaced 1 inch in from the edge of the respective member 7e, 7f. The slots 7h, 7g respectively accommodate the shanks of screws or bolts 16 and 17, which are secured in place by washers and wing nuts, enabling the book plate 3 to be slideably raised to a desired height and fixed in place.

A particular feature of the present invention is the manner of securing and controlling the tension of the line 4, which holds in place the pages of a book or magazine 20 mounted on book plate 3.

Figure 6:
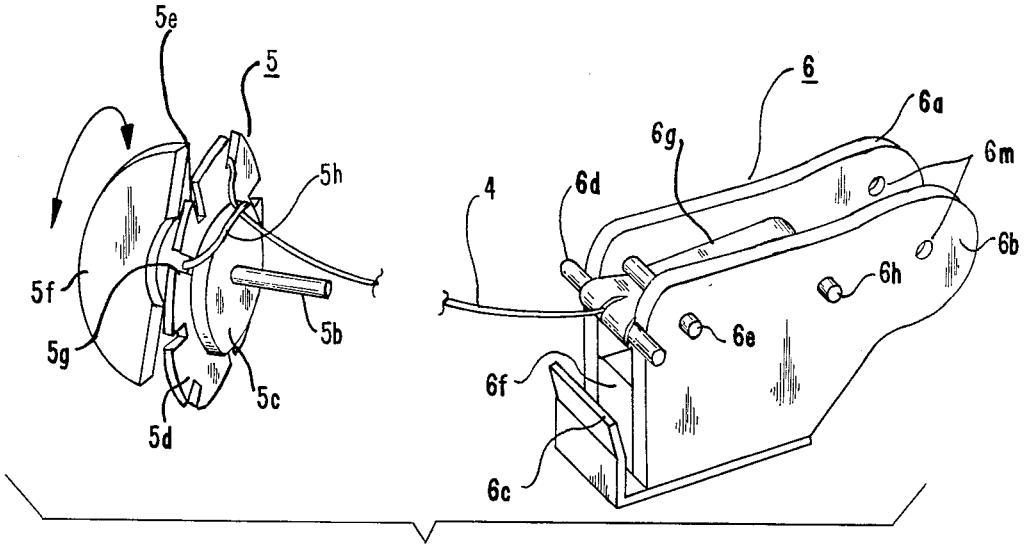
FIG. 6 is perspective showing of the line connected at its opposite ends to the adjustable spool and tensioner, removed from the book support plate.

The line 4 may be, for example, a 25 or 30 pound monofilament line, such as conventionally used for a fish line. One end is connected to tensioner 6, about 2 $\frac{1}{2}$ inches in overall length, which is shown in FIG. 6 removed from the book support i. Tensioner 6 comprises a solid block 6f, say, 1 $\frac{1}{4}$ inches by $\frac{1}{2}$ inch by $\frac{1}{2}$ inch thick, which is enclosed between a pair of flat plates 6a, 6b, $\frac{1}{8}$ inch thick, one end of each of which in contact with the block is substantially rectangular, being 1 $\frac{1}{8}$ inches by 1 inch, sandwiching the block between them, the opposite ends being spaced-apart and extending 2 inches beyond the end of the block to provide dual rounded projecting nubs $\frac{1}{2}$ inch wide at the other end. A peg 6h is interposed through a pair of matching holes normal to the thickness of plates 6a, 6b. An elastic band 6g is stretched between 6h and a second peg 6d which is disposed across the mouth of tensioner 6, bearing against the edges perpendicular to the surfaces of 6a and 6b. A third peg 6e is interposed normal to plates 6a, 6b above the level of pegs 6d and 6h so as to bear against the surface of the elastic band 6g externally. Laterally aligned with peg 6h are a series of holes 6m through the thickness with matching holes in both 6a and 6b so that the position of the peg 6h can be changed from left to right and back to adJust the tension on the elastic band 6g.

Below the peg 6d on the inner face of tensioner 6 is firmly fastened a U-shaped hook 6c, which may be of metal or any similar rigid material, which is 1 inch across the width, and has a lip projecting out, say ¼ inch from the inner face of tensioner 6, and extending up about ¼ inch. The hook 6c so formed is shaped to hook over and slideably engage the outer wall of the channel 3i so that the tensioner 6 can be readily disengaged to turn a page of the book or magazine 20 and then be quickly repositioned to place the line 4 at any desired height on the book plate 3. One end of the line 4 is passed through an opening in the elastic band 6g and anchored in a hole drilled through the center of the peg 6d.

As indicated in FIG. 6, the dispensing end of the line 4 is wrapped around the spool 5. The latter comprises a cylinder 5g which terminates at its outer end in a knob 5f. Coaxial with the cylinder 5g, around which one end of the line 4 is wrapped and anchored, is a disc 5d having a series of peripheral radially-directed slots about ¼ inch deep and symmetrically spaced-apart about ½ inch around the periphery. The line 4 passes through a selected one of the slots 5e in the disc 5d which is axially disposed between the spool 5g and the outer face of the book plate 3. The disc 5d being divided into a number of slots, equally spaced, is thereby able to pay out, or dispense small increments of line 4 to adJust for book thickness while keeping the amount of stretch of the elastic band 5h within its limits. A dowel 5b extends in an axial direction from the inner face of the cylindrical hub 5c which is fixed to the inner surface of the slotted disc 5d. This enables the spool 5 to be mounted in slightly rotatable relation in a friction fit in one of the holes 3j or 3k which are spaced-apart along either of the lateral channels 3i or 3h of the book plate 3. Thus, the tension on the line 4 can be changed by merely rotating tensioner 6 in its mounting hole and/or changing the slot through which the line 4 passes between the spool 5g and the outer face of the book plate 3. This is to prevent line 4 from jumping out of its slot when the anchor is released to turn a page. This lends flexibility to the positioning and tensioning of the line 4 which may be moved up or down along the face of book plate 3, or rendered tight or slack by passing the line 4 through a selected slot in disc 5d. Thus, the position and tension of line 4 may readily be adapted to the thickness and size of the reading matter 20 mounted on the book plate 3. It will be noted that the elastic band 5h, which is of lighter weight than that on line 4, namely 6g, runs across from the two slots straddling the single holding line 4. This is to prevent line 4 from jumping out of its slot when the anchor is released to turn a page. It is also noted that the positions of tensioner 6 and the spool 5 may be reversed as between channels 3h and 3i. These channels give stability to dowel 5b which would tend to wobble if only passing through one thin hole while a thick leg on 3h and 3i makes for awkward hooking of 6c.

Particular advantages of the support for book and reading matter of the present invention are that it permits the book support plate to be raised, lowered or tilted so that the center surface of the reading matter is substantially perpendicular to the reader's line of sight, permitting better overall focusing on what is read. Thus, use of the present invention provides a means for holding a book open without the presence of any mechanism interfering with the material being read. This enables the user to keep a book open without the continuous use of his or her hands. A further advantage of the invention is that by its use right-handed or left-handed readers are readily able to adjust the device to their preference.

It will understood that whereas a specific embodiment of the book or magazine support of the present invention has been described by way of illustration, the invention is not limited to any of the dimensions, shapes, or materials described by way of illustration, but only by the scope of the appended claims.

What I claimed is:

1. A support for books and reading matter which comprises in combination:

a baseboard;

a book plate for supporting reading matter;

means for adjusting and securing the angular position of said book plate in relation to said baseboard;

retaining means in contact with said book plate for retaining the pages of said reading matter open against the base of said book plate, said retaining means comprising an elongated non-elastic line extending laterally across the face of said book plate;

a dispensing device for anchoring and dispensing one end of said line disposed at one lateral edge of said book plate; and means comprising an elastically-biased hook connected at the other end of said non-elastic line in readily detachable relation adjacent to the other lateral edge of said book plate.

2. The combination in accordance with claim 1 wherein said dispensing device comprises a spool for storing the slack of said line, and a slotted disc mounted in coaxial relation to said spool, said disc constructed to accommodate said line in one or more of said slots; and means for slightly rotating said disc about its axis to adjust said line.

3. The combination in accordance with claim 2 wherein an auxiliary continuous elastic band is mounted between two of the slots of said slotted disc, said auxiliary elastic band being disposed to cross over and bear on said line to hold said line in place when said hook is detached from said U-shaped channel.

4. The combination in accordance with claim 1 wherein at least one lateral edge of said book plate comprises a flange substantially normal to the principal surface of said book plate, said flange containing a series of holes spaced-apart along said flange; and wherein said dispensing device, including said spool, terminates in an axially-disposed dowel which is accommodated in slideable relation in any of said holes.

5. The combination in accordance with claim 1 wherein at least one edge of said book plate comprises a channel of U-shaped cross-section; and wherein said U-shaped channel accommodates said hook in slideable snap-on relation.

6. The combination in accordance with claim 1 wherein said baseboard comprises a rectangular frame having a plurality of cross bars extending normally to the front of said book plate, one or more of said cross bars having an elongated slot; and wherein the means for adjusting and securing the angular position of said book plate comprises a back supporting frame in contact with the rear face of said book plate;

one or more legs depending from the lower end of said book supporting frame;

a screw or bolt projecting from the lower end of said one or more legs and serving to mechanically couple the lower end of said longitudinal slot in said one or more cross bars, whereby said screw or bolt moves slideably from back to front and visa versa in said longitudinal slot to raise or lower said book supporting frame, thereby raising and lowering said book plate; and means for tightening said screw or bolt in a preselected position along said longitudinal slot for securing the angular position of said book plate relative to said baseboard.

7. The combination in accordance with claim 6, wherein when in the closed position for said support of books and reading matter, said book plate and said back supporting frame are constructed to be folded against said base support, forming a shallow box-like structure.

8. A support for books and reading matter which comprises in combination:

a baseboard;

a book plate for supporting reading matter;

means for adjusting and securing the angular position of said book plate in relation to said baseboard;

retaining means in contact with said book plate for retaining the pages of said reading matter open against the base of said book plate, said retaining means comprising an elongated non-elastic line extending laterally across the face of said book plate;

a dispensing device for anchoring and dispensing one end of said line disposed at one lateral edge of said book plate; and means comprising an elastically-biased hook connected at the other end of said line in readily detachable relation adjacent to the other lateral edge of said book plate, wherein said means comprising said elastically-biased hook comprises an elongated body having a pair of substantially flat parallel sides projecting upwardly, between them a groove disposed along the length of said elongated body, said elongated body terminating at its inner end in an abrupt edge portion substantially normal to the direction of elongation of said body; said hook projecting upwardly in spaced-apart relation from the lower end of said abrupt edge portion, a pair of pegs comprising an inner and intermediate peg disposed normally to said flat parallel side in spaced-apart relation across said groove, a third peg disposed against said abrupt edge in substantially parallel relation to the pegs of said pair, and a continuous elastic band mounted with its inner ends disposed between said third peg and the inner peg of said pair, said intermediate peg being disposed to bear on the upper surface of said elastic band, said elastic band having an opening centered over said third peg, and said line being connected to the center of said third peg through said opening, whereby to apply an elastic bias to said hook.

* * * * *